US010923098B2

(12) United States Patent
Gauger, Jr. et al.

(10) Patent No.: US 10,923,098 B2
(45) Date of Patent: Feb. 16, 2021

(54) BINAURAL RECORDING-BASED DEMONSTRATION OF WEARABLE AUDIO DEVICE FUNCTIONS

(71) Applicant: Bose Corporation, Framingham, MA (US)

(72) Inventors: Daniel M. Gauger, Jr., Berlin, MA (US); Steven Edward Munley, Bellingham, MA (US); Matthew Eliot Neutra, Sherborn, MA (US); Benjamin Davis Parker, Sudbury, MA (US); Andrew Todd Sabin, Chicago, IL (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/274,648

(22) Filed: Feb. 13, 2019

(65) Prior Publication Data

US 2020/0258493 A1 Aug. 13, 2020

(51) Int. Cl.
*G10K 11/178* (2006.01)
*H04R 1/10* (2006.01)

(52) U.S. Cl.
CPC .... *G10K 11/1787* (2018.01); *G10K 11/17853* (2018.01); *H04R 1/1083* (2013.01); *G10K 2210/1081* (2013.01); *G10K 2210/3028* (2013.01); *G10K 2210/3036* (2013.01)

(58) Field of Classification Search
CPC ..... G10K 11/1787; G10K 11/17853; G10K 2210/1081; G10K 2210/3028; G10K 2210/3036; H04R 1/1083
USPC ..... 381/71.1
See application file for complete search history.

(56) References Cited

U.S. PATENT DOCUMENTS

| | | | |
|---|---|---|---|
| 8,010,366 | B1 | 8/2011 | Kearby et al. |
| 9,149,214 | B2 | 10/2015 | Adachi et al. |
| 2004/0030556 | A1 | 2/2004 | Bennett |
| 2005/0248717 | A1 | 11/2005 | Howell et al. |
| 2009/0085873 | A1 | 4/2009 | Betts |

(Continued)

OTHER PUBLICATIONS

Starkey Sound Demo website, at https://www.starkey.com/sound-demo/st/en/index.html, accessed through wayback machine of archive.org, dated Feb. 12, 2017 (Year: 2017).*

(Continued)

*Primary Examiner* — Paul Kim
*Assistant Examiner* — Douglas J Suthers
(74) *Attorney, Agent, or Firm* — Hoffman Warnick LLC

(57) ABSTRACT

Various implementations include approaches for demonstrating wearable audio device capabilities. In particular aspects, a computer-implemented method of demonstrating a feature of a wearable audio device includes: receiving a command to initiate an audio demonstration mode at a demonstration device; initiating binaural playback of a demonstration audio file at wearable playback device being worn by a user and initiating playback of a corresponding demonstration video file at a video interface coupled with the demonstration device; receiving a user command to adjust a demonstration setting at the demonstration device to emulate adjustment of a corresponding setting on the wearable audio device; and adjusting the binaural playback at the wearable playback device based upon the user command.

20 Claims, 5 Drawing Sheets

(56) References Cited

U.S. PATENT DOCUMENTS

| | | | | |
|---|---|---|---|---|
| 2012/0173187 | A1 | 7/2012 | Lee et al. | |
| 2012/0209601 | A1 | 8/2012 | Jing | |
| 2013/0108994 | A1 | 5/2013 | Srinivasa et al. | |
| 2013/0300648 | A1 | 11/2013 | Kim et al. | |
| 2014/0081631 | A1 | 3/2014 | Zhu et al. | |
| 2015/0248879 | A1* | 9/2015 | Miskimen | G10K 11/178 381/71.6 |
| 2015/0281853 | A1 | 10/2015 | Eisner et al. | |
| 2015/0317125 | A1 | 11/2015 | Jones et al. | |
| 2016/0112817 | A1 | 4/2016 | Fan et al. | |
| 2016/0189565 | A1 | 6/2016 | Rot et al. | |
| 2016/0210872 | A1 | 7/2016 | Roberts et al. | |
| 2016/0301807 | A1 | 10/2016 | Webb et al. | |
| 2016/0381453 | A1 | 12/2016 | Ushakov | |
| 2017/0076738 | A1 | 3/2017 | Freudenthal et al. | |
| 2017/0099380 | A1 | 4/2017 | Lee | |
| 2018/0035216 | A1 | 2/2018 | Van Hasselt et al. | |
| 2019/0035397 | A1 | 1/2019 | Reily et al. | |
| 2019/0035399 | A1 | 1/2019 | Chakladar et al. | |

OTHER PUBLICATIONS

Bragi Dash Pro website with link to demonstration video, available at: https://bragi.com/products/thedashpro (accessed on Nov. 29, 2018).

Dash Pro Showreel, available at: https://www.youtube.com/watch?v=jH9likHtoTA (accessed on Nov. 29, 2018).

Starkey Sound Demo website, available at: https://www.starkey.com/sound-demo/st/en/index.html#page/4 (accessed on Nov. 29, 2018).

U.S. Appl. No. 16/204,375 Office Action dated May 11, 2020, 15 pages.

U.S. Appl. No. 16/204,339 Office Action dated Jun. 11, 2020, 8 pages.

* cited by examiner

BINAURAL RECORDING-BASED DEMONSTRATION OF WEARABLE AUDIO DEVICE FUNCTIONS

TECHNICAL FIELD

This disclosure generally relates to wearable audio devices. More particularly, the disclosure relates to demonstrating capabilities of wearable audio devices.

BACKGROUND

Modern wearable audio devices include various capabilities that can enhance the user experience. However, many of these capabilities go unrealized or under-utilized by the user or potential user due to inexperience with the device functions and/or lack of knowledge of the device capabilities.

SUMMARY

All examples and features mentioned below can be combined in any technically possible way.

Various implementations include approaches for demonstrating wearable audio device capabilities. In certain cases, these approaches include initiating a demonstration to provide a user with an example of the wearable audio device capabilities.

In some particular aspects, a computer-implemented method of demonstrating a feature of a wearable audio device includes: receiving a command to initiate an audio demonstration mode at a demonstration device; initiating binaural playback of a demonstration audio file at a wearable playback device being worn by a user and initiating playback of a corresponding demonstration video file at a video interface coupled with the demonstration device; receiving a user command to adjust a demonstration setting to emulate adjustment of a corresponding setting on the wearable audio device; and adjusting the binaural playback at the wearable playback device based upon the user command.

In additional particular aspects, a demonstration device includes: a command interface for receiving a user command; a video interface for providing a video output; and a control circuit coupled with the command interface and the video interface, the control circuit configured to demonstrate a feature of a wearable audio device by performing actions including: receiving a command, at the command interface, to initiate an audio demonstration mode; initiating binaural playback of a demonstration audio file at a transducer on a connected wearable playback device, and initiating playback of a corresponding demonstration video file at the video interface; receiving a user command, at the command interface, to adjust a demonstration setting to emulate adjustment of a corresponding setting on the wearable audio device; and adjusting the binaural playback at the transducer on the wearable playback device based upon the user command.

Implementations may include one of the following features, or any combination thereof.

In particular aspects, the method further includes: receiving data about an environmental condition proximate the smart device; comparing the data about the environmental condition with an environmental condition threshold corresponding with a clarity level for the feature to be demonstrated; and recommending that the user modify the environmental condition in response to the data about the environmental condition deviating from the environmental condition threshold.

In some cases, the method further includes: receiving data about an environmental condition proximate the demonstration device; comparing the data about the environmental condition with an environmental condition threshold corresponding with a clarity level for the feature to be demonstrated; and either recommending that the user adjust an active noise reduction (ANR) feature in response to the data about the environmental condition deviating from the environmental condition threshold, or automatically adjusting the ANR feature in response to the data about the environmental condition deviating from the environmental condition threshold.

In particular implementations, the wearable playback device is the wearable audio device.

In some cases, the wearable playback device is distinct from the wearable audio device.

In certain aspects, the feature of the wearable audio device includes at least one of: an active noise reduction (ANR) feature, a controllable noise cancellation (CNC) feature, a compressive hear through feature, a level-dependent noise cancellation feature, a fully aware feature, a music on/off feature, a spatialized audio feature, a directionally focused listening feature, an environmental distraction masking feature, an ambient sound attenuation feature, a playback adjustment feature or a directionally adjusted ambient sound feature.

In some implementations, the method further includes initiating binaural playback of an additional demonstration audio file at the wearable playback device, where adjusting the binaural playback includes mixing the demonstration audio file and the additional demonstration audio file based upon the user command.

In particular implementations, the demonstration audio file includes a binaural recording of a sound environment, and adjusting the binaural playback at the wearable playback device includes applying at least one filter to alter the spectrum of the recording.

In certain aspects, the user command to adjust the demonstration setting is received at a user interface on the demonstration device.

In certain cases, adjusting the binaural playback includes simulating a beamforming process in a microphone array focused on an area of visual focus in the demonstration video file.

In some cases, the demonstration device includes a web browser or a solid state media player, and the binaural playback and demonstration settings for the audio demonstration mode are controlled using the web browser or are remotely controlled using the solid state media player.

In particular implementations, the demonstration device includes a sensor system coupled with the control circuit, where the control circuit is further configured to: receive data about an environmental condition proximate the demonstration device from the sensor system; compare the data about the environmental condition with an environmental condition threshold corresponding with a clarity level for the feature to be demonstrated; and recommend that the user modify the environmental condition in response to the data about the environmental condition deviating from the environmental condition threshold.

In certain cases, the demonstration device includes a sensor system coupled with the control circuit, where the control circuit is further configured to: receive data about an environmental condition proximate the demonstration device from the sensor system; compare the data about the environmental condition with an environmental condition threshold corresponding with a clarity level for the feature to be demonstrated; and either recommend that the user adjust an active noise reduction (ANR) feature in response to the data about the environmental condition deviating from the environmental condition threshold, or automatically adjust the ANR feature in response to the data about the environmental condition deviating from the environmental condition threshold.

Two or more features described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

Figure 1:
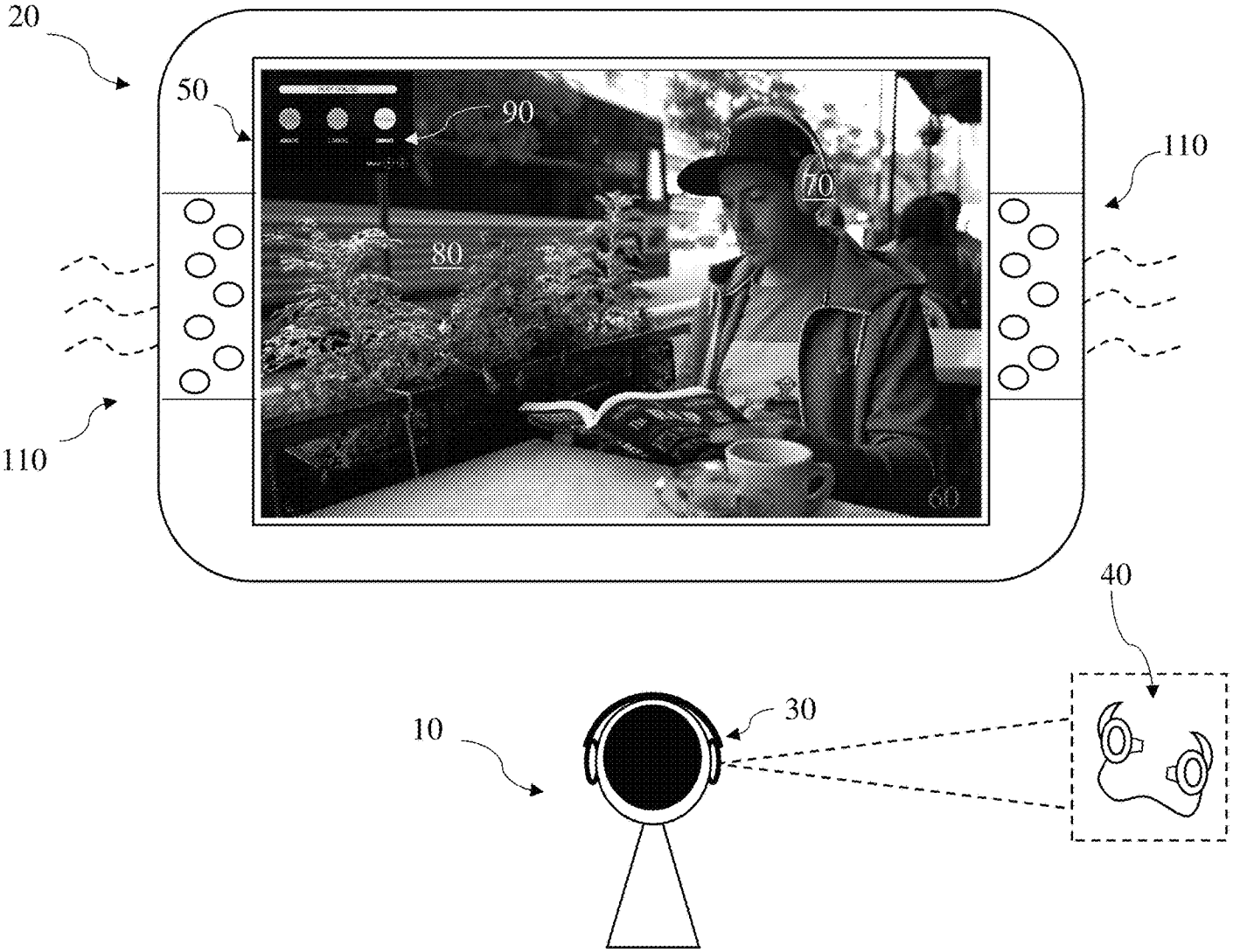
FIG. 1 shows a user interacting with a smart device and a demonstration device in an environment according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that features in a wearable audio device can be beneficially demonstrated to a user. For example, a demonstration device in communication with a wearable playback device can be configured to demonstrate various features of a wearable audio device according to an initiated demonstration mode.

Commonly labeled components in the FIGURES are considered to be substantially equivalent components for the purposes of illustration, and redundant discussion of those components is omitted for clarity.

Conventional communication of the features of a wearable audio device involves reading descriptions about those features, or listening to audio (sometimes combined with video) that simulates a feature, e.g., active cancellation of ambient noise. The user in these scenarios does not interact with the demonstration except to trigger presentation of information.

In contrast, various implementations described herein involve a demonstration device and a wearable playback device that play a combination of binaural audio and video, with controls integrated into or overlaying the video portion of demonstration content. In some examples, the demonstration device includes the video portion of the demonstrated content as well as the integrated or overlaid controls. The controls emulate adjustment of the corresponding setting of a wearable audio device being demonstrated as if it were being used in the real-world setting portrayed in the video. The binaural audio portion of the demonstration content can be presented over a wearable playback device, which may be the wearable audio device being demonstrated or any other wearable audio device (e.g., headphones, earphones or wearable audio system(s)) that the user possesses. The combination of video, accompanying realistic binaural audio and feature-emulating controls that respond to user interaction make the demonstration more engaging and better communicate the capabilities of the wearable audio device being demonstrated.

In some examples, the setting of the wearable audio device being demonstrated may be a sound management feature, e.g., active noise reduction (ANR), controllable noise cancellation (CNC), an auditory compression feature, a level-dependent cancellation feature, a fully aware feature, a music on/off feature, a spatialized audio feature, a voice pick-up feature, a directionally focused listening feature, an audio augmented reality feature, a virtual reality feature or an environmental distraction masking feature.

The implementations described herein enable a user to experience features of a wearable audio device through a set of interactive controls using any type of hardware available to the user, e.g., any wearable playback device. The implementations described herein could be experienced by a user from his or her home, office, or any location where the user is able to establish a connection (e.g., network connection) between his or her wearable playback device and a demonstration device (e.g., a computer, tablet, smart phone, etc.). The implementations described herein could alternatively be experienced by a user in a store environment, or at a kiosk serving as the demonstration device.

It has become commonplace for those who either listen to electronically provided audio (e.g., audio from an audio source such as a mobile phone, tablet, or computer), those who simply seek to be acoustically isolated from unwanted or possibly harmful sounds in a given environment, and those engaging in two-way communications to employ wearable audio devices to perform these functions. For those who employ headphones or headset forms of wearable audio devices to listen to electronically provided audio, it has become commonplace for acoustic isolation to be achieved through the use of active noise reduction (ANR) techniques based on the acoustic output of anti-noise sounds in addition to passive noise reduction (PNR) techniques based on sound absorbing and/or reflecting materials. More advanced ANR features also include controllable noise canceling (CNC), which permits control of the level of the residual noise after cancellation, for example, by a user. CNC enables a user to select the amount of noise that is passed through the headphones to the user's ear—at one extreme, a user could select full ANR and cancel as much residual noise as possible, while at another extreme, a user could select full pass-through and hear the ambient noise as if he or she were not wearing headphones at all. In some examples, CNC can permit a user to control the volume of audio output regardless of the ambient acoustic volume. CNC can allow the user to adjust different levels of noise cancellation using one or more interface commands, e.g., by increasing noise cancellation or decreasing noise cancellation across a spectrum.

Aspects and implementations disclosed herein may be applicable to wearable playback devices that either do or do not support two-way communications, and either do or do not support active noise reduction (ANR). For wearable playback devices that do support either two-way communications or ANR, it is intended that what is disclosed and claimed herein is applicable to a wearable playback device incorporating one or more microphones disposed on a portion of the wearable playback device that remains outside an ear when in use (e.g., feedforward microphones), on a portion that is inserted into a portion of an ear when in use (e.g., feedback microphones), or disposed on both of such portions. Still other implementations of wearable playback devices to which what is disclosed and what is claimed herein is applicable will be apparent to those skilled in the art.

According to various implementations, a demonstration device is used in conjunction with a wearable playback device to demonstrate features of one or more wearable audio devices. These particular implementations can allow a user to experience functions of a wearable audio device that may not be available on the particular (wearable) playback device that the user possesses, or that are available on that (wearable) playback device but may otherwise go unnoticed or under-utilized. These implementations can enhance the user experience in comparison to conventional approaches.

As described herein, the term "playback device" can refer to any audio device capable of providing binaural playback of demonstration audio to a user. In many example implementations, a playback device is a wearable audio device such as headphones, earphones, audio glasses, body-worn speakers, open-ear audio devices, etc. In various particular cases, the playback device is a set of headphones. The playback device can be used to demonstrate features available on that device, or, in various particular cases, can be used to demonstrate features available on a distinct wearable audio device. That is, the "playback device" (or "wearable playback device") is the device worn or otherwise employed by the user to hear demonstration audio during a demonstration process. As described herein, the "wearable audio device" is the subject device, the features of which are being demonstrated on the playback device. In some cases, the wearable audio device and the playback device are the same device. However, in many example implementations, the playback device is a distinct device from the wearable audio device having features that are being demonstrated. The term "demonstration device" can refer to any device with processing capability and connectivity to perform functions of an audio demonstration engine, described further herein. In various implementations, the demonstration device can include a computing device having a processor, memory and a communications system (e.g., a network interface or other similar interface) for communicating with the playback device. In certain implementations, the demonstration device includes a smart phone, tablet, PC, solid state machine, etc.

FIG. 1 is a schematic depiction of an example environment showing a user 10 interacting with a demonstration device 20 and a wearable playback device 30 (e.g., headphones) to hear binaural playback of a demonstration audio file on the playback device 30 and to watch a corresponding demonstration video file on the demonstration device 20. The demonstration device 20 and playback device 30 together simulate for a user 10 how the user 10 would experience sound output through a wearable audio device 40 (e.g., earbuds), illustrated in phantom (which may be the same as or distinct from the playback device 30), where that wearable audio device 40 has certain sound management (or other) features that the user 10 would like to experience. In various implementations, as noted herein, the demonstration device 20 can include a device with network connectivity and a processor (e.g., a DSP) for adjusting audio playback to the user 10 at the playback device 30. In some examples, the demonstration device 20 includes a video interface 50 to play video corresponding with the demonstration audio, however, as noted herein, the video interface 50 can be located at a distinct connected device.

As described further herein, the demonstration device 20 is configured to run an audio demonstration engine to manage demonstration functions according to various implementations. This audio demonstration engine 210 is illustrated in the system diagram in FIG. 4, and can be configured to manage binaural playback of demonstration audio files 250 (e.g., at the wearable playback device 30) as well as playback of demonstration video files 265 at the demonstration device 20. Additional functions of the audio demonstration engine 210 are described with respect to FIGS. 4 and 5.

Figure 2:
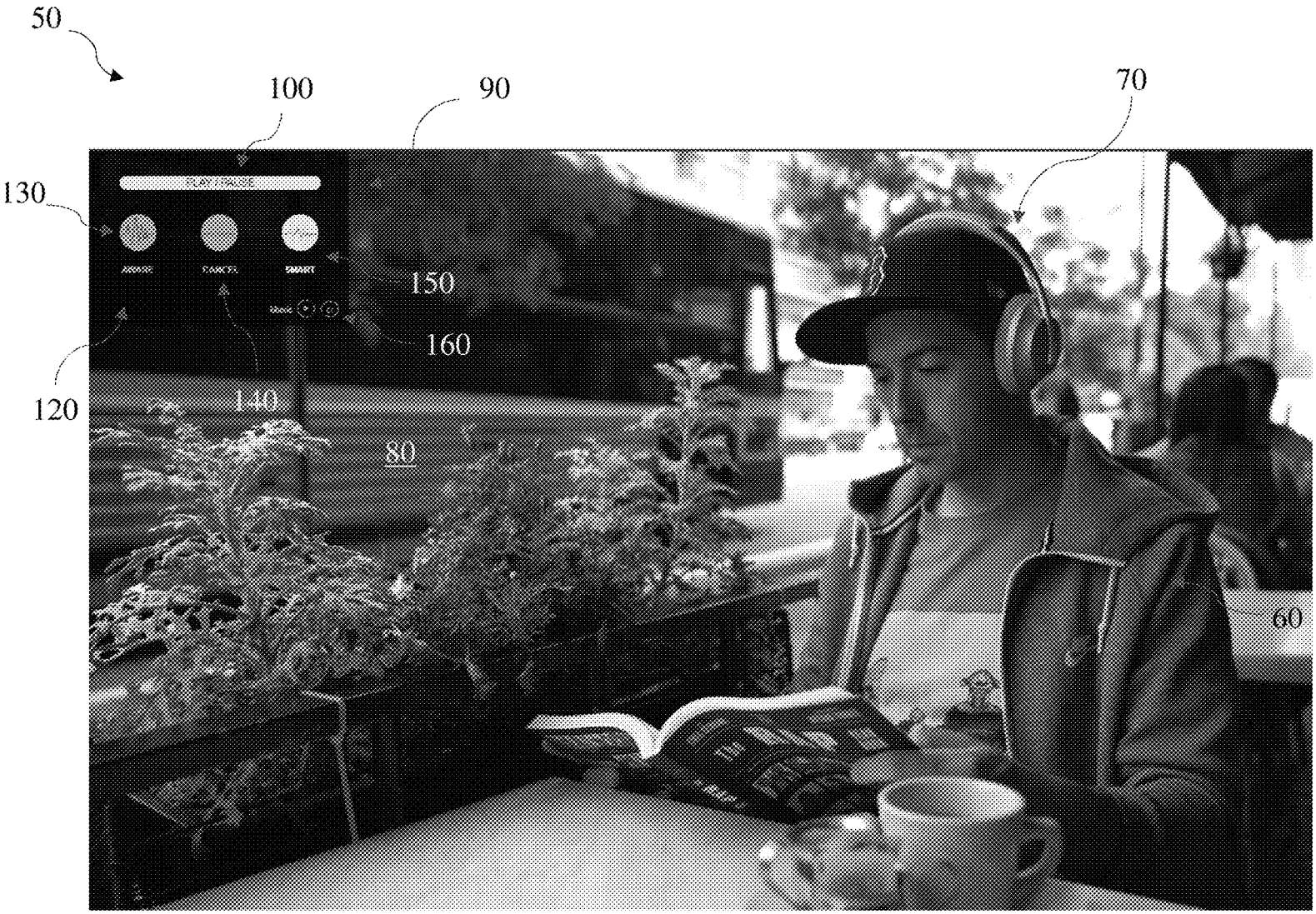
FIG. 2 shows a close-up view the video display from FIG. 1 as seen by a user for demonstrating device functions according to various implementations.

Returning to the example depicted in FIG. 1, the video interface 50 of the demonstration device 20 shows a scene where a user 60 is sitting at a café table wearing headphones 70 while a bus 80 passes in the background. Playback of a demonstration video associated with this scene along with a corresponding binaural demonstration audio file can be initiated and controlled at the demonstration device 20 (or at a distinct connected device, such as a smart phone with an application interface), with playback of the demonstration audio file being streamed to the playback device 30 over a wired or wireless connection (e.g., a wireless communication protocol such as IEEE 802.11, Bluetooth, Bluetooth Low Energy (BLE), or other local area network (LAN) or personal area network (PAN) protocols). Accordingly, the user 10 is able to experience playback of audio through the (wearable) playback device 30 as it would sound through wearable audio device 40 as if the user 10 were actually in the scene depicted on the demonstration device 20, using features available on the playback device 30. A close-up view of the scene illustrated on the video interface 50 in FIG. 1 is shown in FIG. 2. These Figures are referred to simultaneously.

To initiate playback of the demonstration video and audio files, a user may interact with controls 90 on the demonstration device 20 (e.g., by touching the controls or actuating a linked device such as a mouse, stylus, etc.). In particular cases, the controls 90 are presented on the video interface 50 or proximate the video interface 50 at the demonstration device 20, e.g., for ease of manipulation. In other cases, for example, where the playback device 30 is the same device (or same device type) as the wearable audio device 40, a user may initiate playback of the demonstration video and audio files using controls (e.g., similar to controls 90) on the playback device 30, or a distinct connected device, such as a smart phone running an application with a user interface. These cases may be beneficial where the user 10 can (or has) downloaded or otherwise activated a feature for use on the wearable audio device 40, and wishes to control demonstration of those features with controls on the playback device 30.

In the example shown in FIGS. 1 and 2, the user may initiate a demonstration mode by selecting the "PLAY/PAUSE" user interface control 100 on the demonstration device 20. It should be appreciated that controls on the playback device 30 itself (e.g., a user interface button or capacitive touch surface) or controls on a distinct connected device could also be used to initiate the demonstration mode. Once playback of the demonstration video and audio files has been initiated, the demonstration video can be played back on the video interface 50 of demonstration device 20 (or on a video interface of another connected device) and the demonstration audio can be transmitted from the demonstration device 20 to the playback device 30 via a wired or wireless connection. While many implementations can utilize the (wearable) playback device 30 to provide the playback of a demonstration audio file 250 (FIG. 4) to the user 10, in other implementations, the demonstration device 20 (or a distinct audio device, such as a portable speaker) can provide playback of the demonstration audio file 250 to the user via one or more speakers 110 (FIG. 1).

As shown in the example depicted in FIGS. 1 and 2, the video interface 50 includes controls 90, which can include a control interface illustrating example adjustments to demonstration settings related to the demonstration audio file. These controls can include sound management user interface controls 120, allowing the user 10 to adjust the demonstration settings at the demonstration device 20 to emulate adjustment of a corresponding setting on the wearable audio device 40 being demonstrated. Three example sound management interface controls 120 are shown in this depiction: "AWARE" 130, "CANCEL" 140 AND "SMART" 150, respectively. In some examples, "AWARE" 130 may refer to an Aware mode, which permits a user to hear ambient acoustic signals at approximately their naked-ear level, while "CANCEL" 140 may refer to an ANR mode, where ambient acoustic signals are cancelled at the highest noise cancellation setting, and "SMART" 150 may refer to a Smart Aware mode or a Dynamic Awareness mode, where the noise cancellation is automatic and level-dependent. The user 10 (FIG. 1) may toggle between the three modes using the user interface controls 120 to simulate what the environment shown in the video would sound like with each of the three modes selected. In some examples, the user interface controls 120 may also include a "Music" control 160 (e.g., a button or other actuation mechanism), which enables the user to toggle between playing or pausing an audio track, such as music, also being played as part of the demonstration audio file in each of the three modes.

When a new mode is selected from the user interface controls 120, the binaural audio is adjusted at the demonstration device 20 to simulate for the user 10 what that mode would sound like in the environment depicted in the corresponding video. For example, when Aware mode is selected, the binaural audio is adjusted at the demonstration device 20 to simulate for the user 10 at the playback device 30 what Aware mode would sound like in the environment depicted. Similarly, when Cancel mode is selected, the binaural audio is adjusted at the demonstration device 20 to simulate for the user 10 at the playback device 30 what full ANR would sound like in the environment depicted. And when Smart Aware mode is selected, the binaural audio is adjusted at the demonstration device 20 to simulate for the user 10 at the playback device 30 what Smart ANR would sound like in the environment depicted.

In the particular example shown in FIG. 2, the video display 50 depicts a dynamic physical environment (as playback of a demonstration video file 265, FIG. 4), where the bus 80 is driving on the road adjacent the user 60, and pedestrians are walking past the user 60 on the sidewalk. As the bus 80 moves across the screen, the plants next to the user 60 sway in the breeze. Along with playback of this demonstration video file 265 (FIG. 4), an audio demonstration engine 210 running on the demonstration device 20 (FIG. 4) simultaneously plays back the demonstration audio file 250 corresponding with this video playback, e.g., binaural playback of the recorded acoustic signals detected at the time of filming the video and/or post-processed acoustic signals that are modified to emulate the experience that the user 60 has in the scene. The user 10 experiencing this demonstration can hear the bus 80 (via transducer playback at the playback device 30) as it enters the video display 50, and additionally hear ambient acoustic sounds that may not be visible in the snapshot view of the display, e.g., a couple talking at a nearby table, a server asking the user 60 for a menu selection, or a bird chirping. In response to a user command to demonstrate one or more of the functions of the wearable audio device 40 (e.g., a selection command to select one of the modes displayed, such as Aware mode (AWARE selection 130), Cancel mode (CANCEL selection 140), or Smart mode (SMART selection 150)), the audio demonstration engine 210 (FIG. 4) plays back an adjusted demonstration audio file 250 (FIG. 4) corresponding to the selected mode, or otherwise manipulates one or more the binaural audio files to emulate operation of the wearable audio device 40 in that situation.

In response to a user command for Music On/Play (Music control 160), the audio demonstration engine 210 (FIG. 4) responds to that user command by mixing a WAV file or compressed audio file including music with the demonstration audio file 250 to demonstrate how the user 60 hears that music while in the environment, with any of the modes selected. The music file could be any type of audio file, including music, a voice phone call, a series of tones, an audiobook or podcast, etc. For example, in place of a music file, the demonstration audio file(s) 250 can be mixed with a recording of a voice call (by phone or other conventional means) to demonstrate how the user 60 would hear voice call audio while in that environment, with any of the modes selected.

Figure 3:
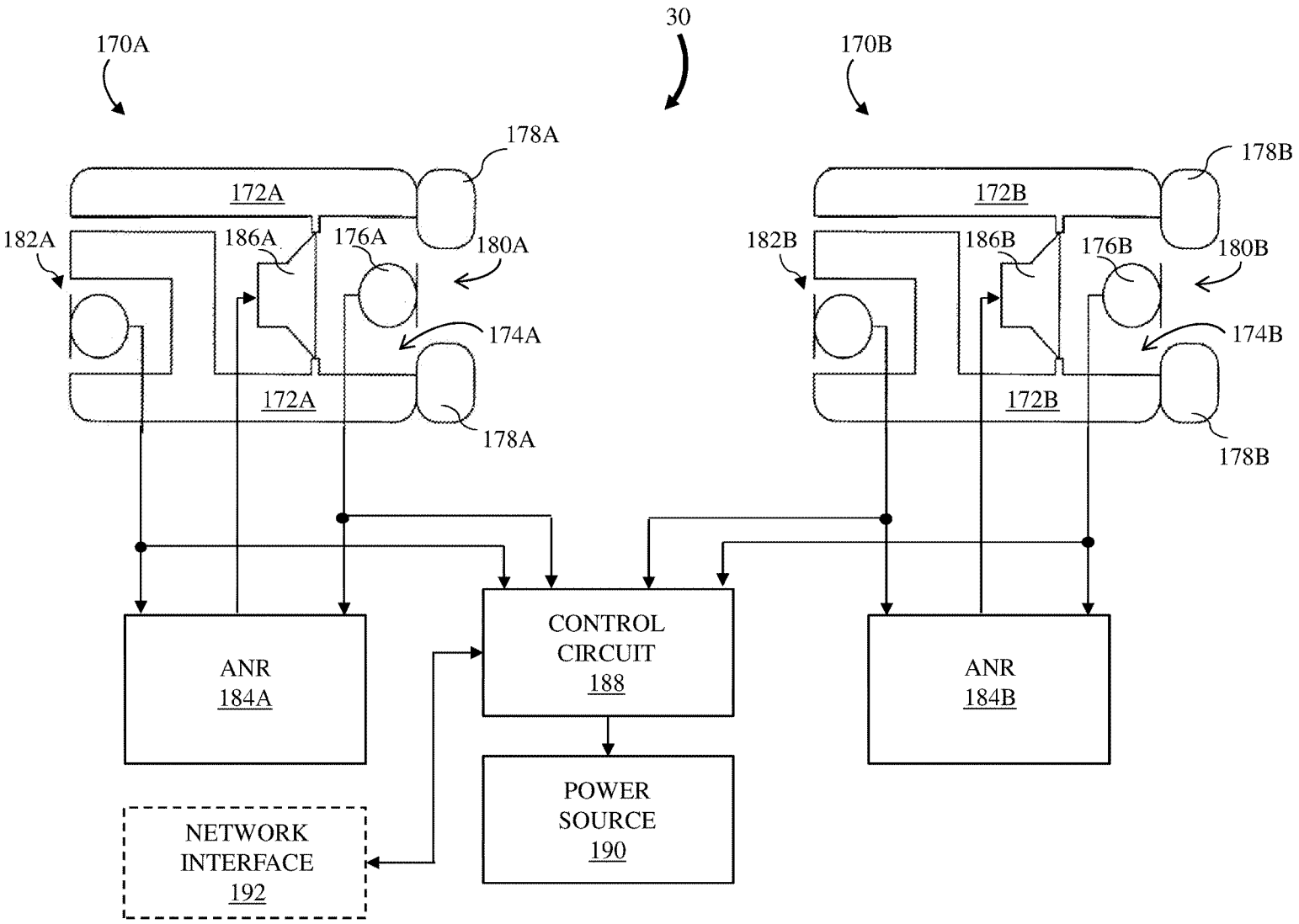
FIG. 3 is a block diagram depicting an example playback device according to various disclosed implementations.
Figure 4:
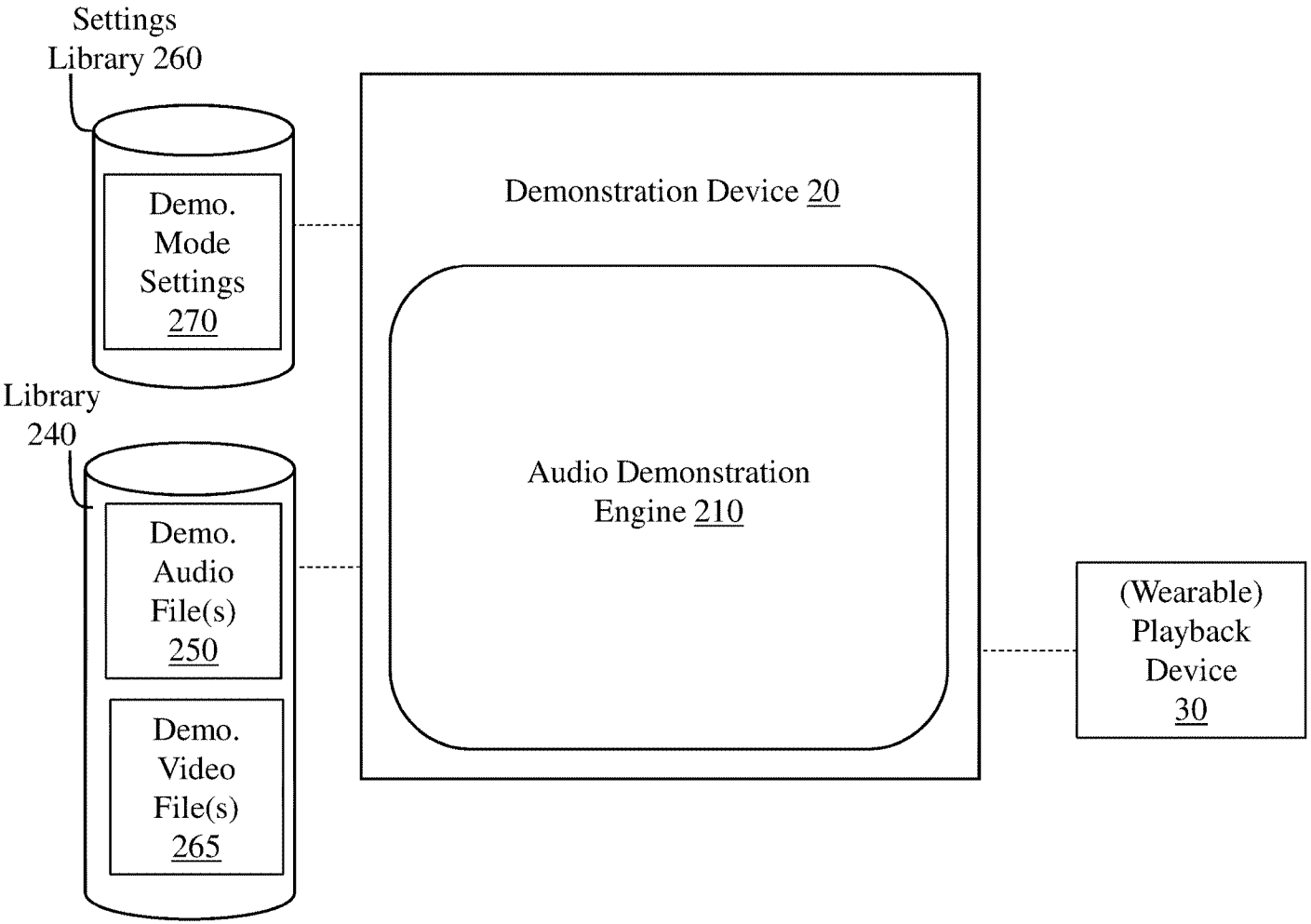
FIG. 4 is a schematic data flow diagram illustrating control processes performed by an audio demonstration engine in a smart device, according to various implementations.

Turning to FIGS. 3 and 4, examples of the wearable playback device 30 and demonstration device 20, respectively, are shown. FIG. 3 is a block diagram of an example of a playback device 30 having two earpieces 170A and 170B, each configured to direct sound towards an ear of a user. This playback device 30 is merely one example of a playback device, which can demonstrate the functions of a wearable audio device 40 (FIG. 1) (which may be the playback device itself or a distinct device from the playback device) through an audio demonstration engine 210 (FIG. 4) running on the demonstration device 20, and in some cases, a smart device connected with the demonstration device 20, according to various implementations. Reference numbers appended with an "A" or a "B" indicate a correspondence of the identified feature with a particular one of the earpieces 170 (e.g., a left earpiece 170A and a right earpiece 170B). Each earpiece 170 includes a casing 172 that defines a cavity 174. In some examples, one or more internal microphones (inner microphone) 176 may be disposed within cavity 174. An ear coupling 178 (e.g., an ear tip or ear cushion) attached to the casing 172 surrounds an opening to the cavity 174. A passage 180 is formed through the ear coupling 178 and communicates with the opening to the cavity 174. In some examples, an outer microphone 182 is disposed on the casing 172 in a manner that permits acoustic coupling to the environment external to the casing 172.

In implementations that include ANR (which may include CNC), the inner microphone 176 may be a feedback microphone and the outer microphone 182 may be a feedforward microphone. In such implementations, each earphone 170 includes an ANR circuit 184 that is in communication with the inner and outer microphones 176 and 182. The ANR circuit 184 receives an inner signal generated by the inner microphone 176 and an outer signal generated by the outer microphone 182, and performs an ANR process for the corresponding earpiece 170. The process includes providing a signal to an electroacoustic transducer (e.g., speaker) 186 disposed in the cavity 174 to generate an anti-noise acoustic signal that reduces or substantially prevents sound from one or more acoustic noise sources that are external to the earphone 170 from being heard by the user. As described herein, in addition to providing an anti-noise acoustic signal, electroacoustic transducer 186 can utilize its sound-radiating surface for providing an audio output for playback.

In implementations of a playback device 30 that include an ANR circuit 184, the corresponding ANR circuit 184A,B is in communication with the inner microphones 176, outer microphones 182, and electroacoustic transducers 186, and receives the inner and/or outer microphone signals. In certain examples, the ANR circuit 184A,B includes a microcontroller or processor having a digital signal processor (DSP) and the inner signals from the two inner microphones 176 and/or the outer signals from the two outer microphones 182 are converted to digital format by analog to digital converters. In response to the received inner and/or outer microphone signals, the ANR circuit 184 can communicate with a control circuit 188 to initiate various actions. For example, audio playback may be initiated, paused or resumed, a notification to a wearer may be provided or altered, and a device in communication with the wearable audio device may be controlled. In implementations of the playback device 30 that do not include an ANR circuit 184, the microcontroller or processor (e.g., including a DSP) can reside within the control circuit 188 and perform associated functions described herein.

The playback device 30 may also include a power source 190. The control circuit 188 and power source 190 may be in one or both of the earpieces 170 or may be in a separate housing in communication with the earpieces 170. The playback device 30 may also include a network interface 192 to provide communication between the playback device 30 and one or more audio sources and other audio devices (including demonstration device, as described herein). The network interface 192 may be wired (e.g., Ethernet) or wireless (e.g., employ a wireless communication protocol such as IEEE 802.11, Bluetooth, Bluetooth Low Energy (BLE), or other local area network (LAN) or personal area network (PAN) protocols).

Network interface 192 is shown in phantom, as portions of the interface 192 may be located remotely from playback device 30. The network interface 192 can provide for communication between the playback device 30, audio sources and/or other networked (e.g., wireless) speaker packages and/or other audio playback devices via one or more communications protocols. The network interface 192 may provide either or both of a wireless interface and a wired interface. The wireless interface can allow the playback device 30 to communicate wirelessly with other devices in accordance with any communication protocol noted herein.

In some cases, the network interface 192 may also include a network media processor for supporting, e.g., Apple AirPlay® (a proprietary protocol stack/suite developed by Apple Inc., with headquarters in Cupertino, Calif., that allows wireless streaming of audio, video, and photos, together with related metadata between devices) or other known wireless streaming services (e.g., an Internet music service such as: Pandora®, a radio station provided by Pandora Media, Inc. of Oakland, Calif., USA; Spotify®, provided by Spotify USA, Inc., of New York, N.Y., USA); or vTuner®, provided by vTuner.com of New York, N.Y., USA); and network-attached storage (NAS) devices). As noted herein, in some cases, control circuit 188 can include a processor and/or microcontroller, which can include decoders, DSP hardware/software, etc. for playing back (rendering) audio content at electroacoustic transducers 186. In some cases, network interface 192 can also include Bluetooth circuitry for Bluetooth applications (e.g., for wireless communication with a Bluetooth enabled audio source such as a smartphone or tablet). In operation, streamed data can pass from the network interface 192 to the control circuit 188, including the processor or microcontroller. The control circuit 188 can execute instructions (e.g., for performing, among other things, digital signal processing, decoding, and equalization functions), including instructions stored in a corresponding memory (which may be internal to control circuit 188 or accessible via network interface 192) or other network connection (e.g., cloud-based connection). The control circuit 188 may be implemented as a chipset of chips that include separate and multiple analog and digital processors. The control circuit 188 may provide, for example, for coordination of other components of the playback device 30, such as control of user interfaces (not shown) and applications run by the playback device 30.

In implementations of the playback device 30 having an ANR circuit 184, that ANR circuit 184 can also include one or more digital-to-analog (D/A) converters for converting the digital audio signal to an analog audio signal. This audio hardware can also include one or more amplifiers which provide amplified analog audio signals to the electroacoustic transducer(s) 186, which each include a sound-radiating surface for providing an audio output for playback. In addition, the audio hardware may include circuitry for processing analog input signals to provide digital audio signals for sharing with other devices. However, in additional implementations of the playback device 30 that do not include an ANR circuit 184, these D/A converters, amplifiers and associated circuitry can be located in the control circuit 188.

The memory in control circuit 188 can include, for example, flash memory and/or non-volatile random access memory (NVRAM). In some implementations, instructions (e.g., software) are stored in an information carrier. The instructions, when executed by one or more processing devices (e.g., the processor or microcontroller in control circuit 188), perform one or more processes, such as those described elsewhere herein. The instructions can also be stored by one or more storage devices, such as one or more (e.g. non-transitory) computer- or machine-readable mediums (for example, the memory, or memory on the processor/microcontroller). It is understood that portions of the control circuit 188 (e.g., instructions) could also be stored in a remote location or in a distributed location, and could be fetched or otherwise obtained by the control circuit 188 (e.g., via any communications protocol described herein) for execution.

FIG. 4 is a schematic data flow diagram illustrating functions performed by an audio demonstration engine 210 running on a demonstration device 20 (e.g., demonstration device 20, shown in FIG. 1). The demonstration device 20 can be coupled with a (wearable) playback device 30, which as described herein, can have one or more of the capabilities of the wearable audio device 40 (FIG. 1) being demonstrated, or may be configured to emulate those capabilities using binaural playback controlled by the audio demonstration engine 210. As described herein, the audio demonstration engine 210 is configured to implement demonstrations of various acoustic-related features (e.g., sound management features) of the wearable audio device 40 (FIG. 1), using the demonstration device 20 and the wearable playback device 30.

One or more portions of the audio demonstration engine 210 (e.g., software code and/or logic infrastructure) can be stored on or otherwise accessible to one or more demonstration devices 20, which may be connected with the playback device 30 by any communications connection described herein (e.g., via wireless or hard-wired connection). In various additional implementations, the demonstration device(s) 20 can include a separate audio playback device, such as a conventional speaker, and can include a network interface or other communications module for communicating with the playback device 30 or another device in a network or a communications range.

Figure 5:
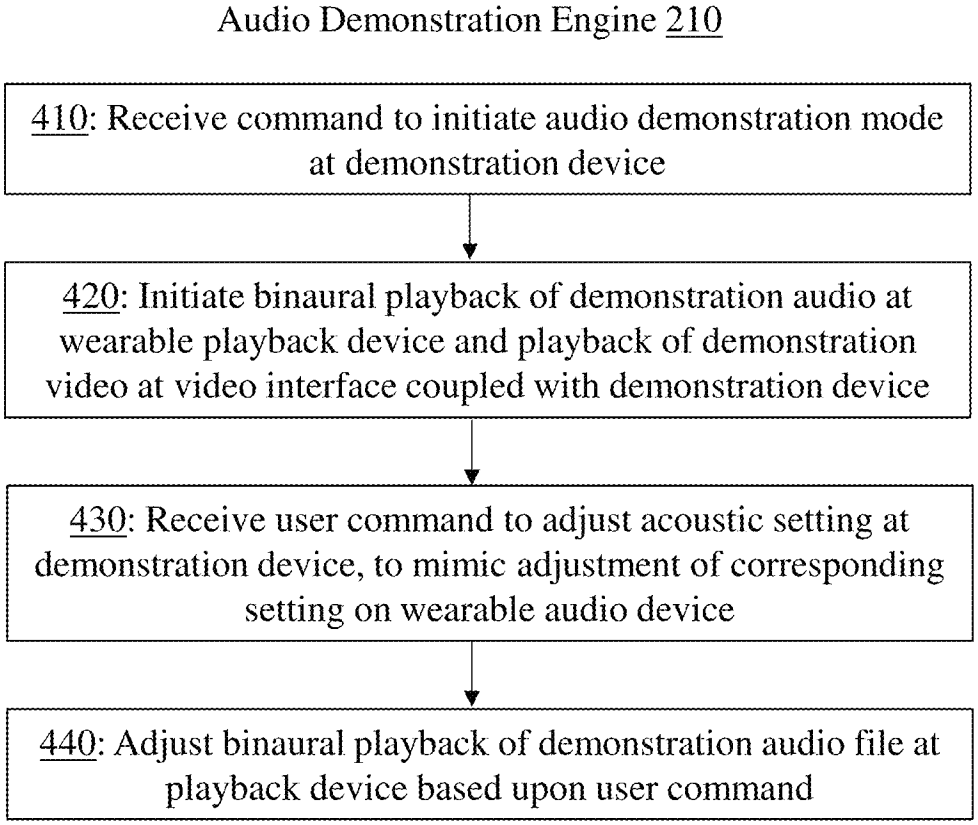
FIG. 5 is a process flow diagram illustrating processes performed by the audio demonstration engine shown in FIG. 2.

In particular, FIG. 4 shows a schematic data flow diagram illustrating a control process performed by audio demonstration engine 210 in connection with a user, such as the human user 10 shown in FIG. 1. FIG. 5 shows a process flow diagram illustrating processes performed by the audio demonstration engine 210 according to various implementations. FIGS. 4 and 5 are referred to simultaneously, with continuing reference to FIGS. 1 and 2.

Returning to FIG. 4, data flows between the audio demonstration engine 210 and other components are shown. It is understood that one or more components shown in the data flow diagram may be integrated in the same physical housing, e.g., in the housing of the demonstration device 20, or may reside in one or more separate physical locations.

Audio demonstration engine 210 can be coupled (e.g., wirelessly and/or via hardwired connections) with a library 240, which can include demonstration audio files 250 and demonstration video files 265 for playback (e.g., streaming) at the (wearable) playback device 30 and/or another audio playback device, e.g., speakers 110 on the demonstration device 20 (FIG. 1).

Library 240 can also be associated with digital audio sources accessible via network interface 192 (FIG. 3) described herein, including locally stored, remotely stored or Internet-based audio libraries. Demonstration audio files 250 are configured for playback at the playback device 30 and/or the demonstration device 20 to aid in demonstrating various functions of the wearable audio device 40 (FIG. 1). In some particular cases, demonstration audio files 250 include binaural recordings configured for playback at one or more devices (e.g., playback device 30) to demonstrate functions of the wearable audio device 40 (FIG. 1). These demonstration audio files 250 can include waveform audio (WAV) files or compressed audio files capable of mixing with other demonstration audio files 250 or with streamed audio (e.g., music) to demonstrate different functions of the wearable audio device 40. In certain implementations, the demonstration audio file 250 includes a binaural recording of a sound spectrum that can be adjusted for playback based on settings or selections by a user experiencing the demonstration. Additionally, the demonstration audio file(s) 250 can include post-processed audio files for emulating the experience of the user within the depicted scene (e.g., as shown in FIG. 2). In particular cases, the settings or selections in turn adjust the binaural recording in some manner, e.g., by applying at least one filter to modify the sound spectrum.

Additionally, the demonstration audio file(s) 250 can include multiple sets of audio files, with each set representing a different combination of the demonstration settings available in the controls 90 (FIG. 2). In various implementations, the different sets of audio files are processed (e.g., equalized) differently for different playback devices 30. For example, where the playback device 30 is known to be a wearable headphone, the audio demonstration engine 210 can play back one or more sets of audio files that include binaural audio. In other cases, where the playback device 30 is a speaker with limited bass output (e.g., a Bluetooth speaker), the audio demonstration engine 210 can play back one or more sets of audio files that include a monaural signal that is equalized according to the characteristics of the type of playback device 30 (e.g., characteristics of a speaker with limited bass output).

In some particular implementations, the demonstration video file(s) 265 can include a video file (or be paired with a corresponding audio file) for playback on an interface (e.g., video interface 50 on demonstration device 20 in FIGS. 1 and 2 and/or a separate connected interface). The video file 265 is synchronized with the audio playback at the (wearable) playback device 30 to provide the user with an immersive demonstration experience. Playback of the audio and/or video can be controlled by the audio demonstration engine 210, which is run on a processing component on the demonstration device 20. Content can be stored locally on the demonstration device 20 and streamed (via a wired or wireless connection) to the playback device 30, streamed from a cloud service to the playback device 30, or streamed from a cloud service to the demonstration device 20, which in turn streams the content (via a wired or wireless connection) to the playback device 30. Content can also be dynamically stored and synched between the playback device 30, demonstration device 20 and the cloud at runtime.

Audio demonstration engine 210 can also be coupled with a settings library 260 containing demonstration mode settings 270 for one or more audio demonstration modes. The demonstration mode settings 270 are associated with operating modes of a model of the device being used for audio playback during the demonstration (i.e., the wearable audio device (FIG. 1) or the playback device 30). For example, where the user is demonstrating a feature of the playback device 30, the demonstration mode settings 270 can be associated with operating modes of the model of the playback device 30. In other cases, where the user is demonstrating a feature of a distinct wearable audio device 40, the demonstration mode settings can be associated with operating functions of that distinct wearable audio device 40 (FIG. 1).

For example, the demonstration mode settings 270 can dictate how the device being demonstrated would play back audio to the user if the user were wearing the that device by simulating how play back would sound on the wearable audio device 40. That is, the demonstration mode settings 270 can indicate values (and adjustments) for one or more control settings (e.g., acoustic settings) on the playback device 30 to provide particular wearable audio device features that affect what the user would hear were they actually using the device being demonstrated in the situation portrayed in the demonstration. These demonstration mode settings 270 can be used to demonstrate wearable audio device features by manipulating and mixing a user's ability to hear ambient sound surrounding the user and their streamed audio content. These wearable audio device features can include at least one of: a compressive hear through feature (also referred to as automatic, level-dependent dynamic noise cancellation, e.g., as described in U.S. patent application Ser. No. 16/124,056, filed Sep. 6, 2018, titled "Compressive Hear-through in Personal Acoustic Devices", which is herein incorporated by reference in its entirety), a fully aware feature (e.g., reproduction of the external environment without any noise reduction/cancelation), a music on/off feature, a spatialized audio feature, a directionally focused listening feature, an active noise reduction (ANR) feature a controllable noise cancellation (CNC) feature, a level-dependent cancellation feature, an environmental distraction masking feature, an ambient sound attenuation feature, a playback adjustment feature (e.g., adjusting an audio stream) or a directionally adjusted ambient sound feature (e.g., varying based upon noise in the environment, presence and/or directionality of voices in the environment, user motion such as head motion, whether the user is speaking, and/or proximity to objects in the environment). Settings controlled to achieve these features can include one or more of: a filter to control the amount of noise reduction or hear-through provided to the user, a directivity of a microphone array in the (wearable) playback device 30, a microphone array filter on the microphone array in the (wearable) playback device 30, a volume of audio provided to the user at the (wearable) playback device 30, a number of microphones used in the microphone array at the device being demonstrated (e.g., wearable audio device 40), ANR or awareness settings, or processing applied to one or more microphone inputs.

As noted herein, demonstration device 20 can be used to initiate binaural playback of the demonstration audio file 250 at the playback device 30 and the corresponding demonstration video file 265 at a video interface (e.g., video interface 50 at the demonstration device 20) to demonstrate functions of the playback device or a distinct wearable audio device to the user. As noted herein, it is understood that one or more functions of the audio demonstration engine 210 can be stored, accessed and/or executed at demonstration device 20.

Audio demonstration engine 210 may also be configured to receive sensor data from a sensor system located at the demonstration device 20, at the wearable playback device 30 or connected with the demonstration device 20 via another device connection (e.g., a wireless connection with another smart device having the sensor system). This sensor data can be used, for example, to detect environmental or ambient noise conditions in the vicinity of the demonstration to make adjustments to the demonstration audio and/or video based on the detected ambient noise. That is, the sensor data can be used to help the user experience the acoustic environment depicted on the video interface 50 as though he/she were in the shoes of the depicted user 60 (FIGS. 1 and 2). The sensor system may include one or more microphones, such as the microphones 176,182 described with reference to FIG. 3. In one particular example described further herein, a microphone located at the demonstration device 20 and/or at the playback device 30 can be configured to detect ambient acoustic signals, and the audio demonstration engine 210 can be configured to assess the viability of one or more demonstration modes based upon the detected ambient acoustic signals (e.g., noise level).

According to various implementations, the demonstration device 20 runs the audio demonstration engine 210, or otherwise accesses program code for executing processes performed by audio demonstration engine 210 (e.g., via a network interface). Audio demonstration engine 210 can include logic for processing commands from the user about the feature demonstrations. Additionally, audio demonstration engine 210 can include logic for adjusting binaural playback at the playback device 30 and video playback (e.g., at the demonstration device 20 or another connected device) according to user input. The audio demonstration engine 210 can also include logic for processing sensor data, e.g., data about ambient acoustic signals from microphones.

As noted herein, audio demonstration engine 210 can include logic for performing audio demonstration functions according to various implementations. FIG. 5 shows a flow diagram illustrating processes in audio demonstration performed by the audio demonstration engine 210 and its associated logic.

In various implementations, the audio demonstration engine 210 is configured to receive a command, at the demonstration device 20, to initiate an audio demonstration mode (process 410, FIG. 5), e.g., a user command at an interface on the demonstration device 20. In certain cases, the user can initiate the audio demonstration mode through a software application (or, app) running on the demonstration device 20 and/or a distinct connected device (such as the playback device 30). The interface on the demonstration device 20 can include a tactile interface, graphical user interface, voice command interface, gesture-based interface and/or any other interface described herein. In some cases, the audio demonstration engine 210 can prompt the user to begin a demonstration process, e.g., using any prompt described herein. In certain implementations, the demonstration mode can be launched via an app or other program running on the demonstration device 20. In additional cases, the user can initiate the audio demonstration mode on a demonstration device 20 that includes a web browser hosted on the demonstration device 20 or at one or more connected devices (e.g., PC, tablet, etc.), permitting control via browser adjustments. In further cases, the user can initiate the audio demonstration mode on a demonstration device 20 that includes a solid state media player, for example, as provided at a retail location or a demonstration site.

In some implementations, in response to the user command, the audio demonstration engine 210 can initiate binaural playback of a demonstration audio file 250 at the wearable playback device 30 (e.g., a set of headphones, earphones, smart glasses, etc.) and playback of the corresponding demonstration video file 265 at a video interface that is coupled with the demonstration device 20 (e.g., a video interface at the demonstration device 20, or a video interface on another smart device connected with the demonstration device 20) (process 420, FIG. 5). As noted herein, in some cases, the demonstration audio file 250 can include a WAV file or compressed audio files storing a binaural recording of a sound spectrum. The demonstration video file 265 can be synchronized with the demonstration audio file 250, such that the user sees a video display (e.g., on demonstration device 20 or a coupled video interface) that corresponds with the binaural playback of the demonstration audio file 250 (e.g., at the wearable playback device 30).

While the demonstration audio file 250 and demonstration video file 265 are being played back, the audio demonstration engine 210 is further configured to receive a user command to adjust a demonstration setting at the demonstration device 20 (e.g., via controls 90 or other enabled controls) to emulate adjustment of a corresponding setting on the wearable audio device 40 (FIG. 1) being demonstrated (process 430, FIG. 5). In various implementations, the user command can include a tactile, voice or gesture command made at one or more interfaces (e.g., at the video interface 50 on demonstration device 20, shown in FIGS. 1 and 2, or via one or more motion sensors at the demonstration device 20 and/or playback device 30). In some examples, the user command includes an interface command to demonstrate one or more features of a wearable audio device 40 on the playback device 30 that the user is currently wearing. In one particular example, the user selects from a menu of features available at the wearable audio device 40, such as ANR mode or Aware mode. As noted herein, these features are associated with acoustic settings (e.g., demonstration mode settings 270) that provide the audio playback at the playback device 30 in a manner that emulates the settings present on the wearable audio device 40 being demonstrated when such features are enabled (FIG. 1).

Based upon the user command (process 430, FIG. 5), the audio demonstration engine 210 adjusts the binaural playback of the demonstration audio file 250 at the playback device 30 (process 440, FIG. 5). In some example cases, where the demonstration audio file 250 includes a binaural recording of a sound environment, adjusting the binaural playback at the playback device 30 includes applying at least one filter to alter the spectrum of the recording. This filtering can be used to emulate various features of the wearable audio device 40 (FIG. 1) being demonstrated at the playback device 30.

In one particular example, binaural playback can be adjustable to simulate manually controlled CNC and auditory limiting (also referred to as compressive hear through). In this scenario, the demonstration audio file(s) 250 include a mixing of four synchronized binaural audio files. One such file can represent the sound of a scene as recorded/mixed, as it would be heard open-eared (i.e., as if the user were not wearing any headphones). This demonstration audio file 250 can be referred to as the 'aware' file, and is generated using filters that emulate the net effect of an Aware mode insertion gain applied in the wearable device to be demonstrated. An example of an Aware mode insertion gain is described in U.S. Pat. No. 8,798,283, the entire content of which is incorporated by reference herein. A second file can represent the sound of a scene with noise cancellation at its highest level. This demonstration audio file 250 is created by filtering through the attenuation response of the wearable audio device 40 being demonstrated, in full noise cancelling, using digital filtering techniques. This filtering can be performed once and stored as an additional demonstration audio file 250, which can be referred to as the 'cancel' file. A third demonstration audio file 250 is created by filtering the initial (aware) signal through a compressor starting at a threshold and compression ratio representative of the wearable audio device 40 being demonstrated. The filtering is performed across the frequency spectrum to emulate the processing performed by the ANR circuit and/or control circuit in the wearable audio device 40 to be demonstrated. This audio demonstration audio file 250 is then stored, and can be referred to as the 'smart' file.

In this example, in order to demonstrate CNC to the user, as the adjustment (e.g., via a video interface such as interface 50 in FIG. 1) is made by user command, the 'aware' file is scaled down by an amount representative of the CNC control taper in the wearable audio device 40 being demonstrated, then summed with the 'cancel' file before sending to the playback device 30 that is used in the demonstration. The scaling down and summation may occur within the audio demonstration engine 210 of the demonstration device 20. If the switch is flipped to 'smart' (for 'smart aware'), e.g., by user command, then the only file played is the pre-compressed 'smart' file. This example configuration can also include a fourth binaural demonstration audio file 250, including a music clip that can be selectively mixed in with the other demonstration audio files, for example, with its own volume control or at a fixed volume most appropriate for supporting the demonstration of the feature (e.g., CNC and/or auditory limiting).

In particular cases, the audio demonstration engine 210 is configured to detect that the user is attempting to adjust a control value (e.g., via the interface at the demonstration device 20) while the user is in an environment where that control adjustment will not be detectable (i.e., audible) to the user when played back on the playback device 30. In these cases, the audio demonstration engine 210 can receive data about ambient acoustic characteristics (e.g., ambient noise level (SPL)) from one or more microphones in the demonstration device 20, playback device 30, and/or a connected sensor system. In one example, where the user 10 is trying to adjust the compressive hear through threshold in an environment having a detected SPL that is quieter than that threshold, the audio demonstration engine 210 is configured to provide the user 10 with a notification (e.g., user interface notification such as a pop-up notification or voice interface notification) that the ambient noise level is insufficient to demonstrate this feature.

While various audio device features are discussed herein by way of example, the audio demonstration engine 210 is configured to demonstrate any number of features of a wearable audio device (e.g., wearable audio device 40, FIG. 1) that may not be in the user's possession. For example, in some example cases, various directional hearing features can be demonstrated using a static visual presentation. In these cases, the user 10 is presented with a scene in the video interface 50 that remains focused in the same view throughout the demonstration. That is, the user 10 is presented with a video depiction of a scene from a fixed camera angle. In these cases, the audio demonstration engine 210 (FIG. 4) is configured to demonstrate directional hearing features by permitting the user to switch between an omnidirectional mode and one or more focused hearing modes. More specifically, the user 10 can make one or more interface commands (e.g., via video interface 50, FIG. 1) to select omnidirectional hearing, and/or one or more focused hearing modes (e.g., Left Focus, Right Focus, Object Focus). The audio demonstration engine 210 (FIG. 4) is configured to receive the user command to demonstrate one or more of these modes, and initiate playback of a stored binaural audio recording (or a monaural audio recording and/or a post-processed audio recording) associated with that mode at the demonstration device 20. In other cases, virtual reality (VR) video capabilities can be demonstrated, e.g., by tracking movement of the demonstration device and adjusting both the visual scene displayed in a video interface (e.g., video interface 50, FIG. 1) and the playback of the demonstration audio file 250. Additional examples can include contextually aware control of ANR and/or CNC based upon actions of the user (e.g., user 10, FIG. 1) and/or proximity to other devices.

In some additional cases, the audio demonstration engine 210 is further configured to initiate binaural playback of an additional demonstration audio file 250 at the demonstration device 20. In some cases, the additional demonstration audio file 250 is played back with the original demonstration audio file 250, such that adjusting the original demonstration audio file 250 includes mixing the two demonstration audio files 250 for playback at the transducers on the demonstration device 30. In some cases, these audio demonstration files 250 are mixed based upon the user command (e.g., a command to demonstrate a particular feature). In certain cases, the demonstration audio files 250 include WAV files or compressed audio files, and adjusting the playback of the demonstration video file 265 is based upon mixing the demonstration audio files 250 (e.g., as described with reference to process 440 in FIG. 3). In various implementations, two or more demonstration audio files 250 can be mixed to demonstrate acoustic features of the device.

In additional implementations, where a user intends to demonstrate sound management features of a wearable audio device (e.g., wearable audio device 40, FIG. 1), e.g., in a noisy environment, the audio demonstration engine 210 is configured to notify the user about the potential challenges of demonstrating features in such an environment. For example, the audio demonstration engine 210 can: a) receive data about an environmental condition proximate the (wearable) playback device 30 (e.g., data gathered via playback device 30 or demonstration device 20), b) compare that data with an environmental condition threshold corresponding with a clarity level for the feature to be demonstrated, and c) recommend that the user modify the environmental condition in response to the data about the environmental condition deviating from the environmental condition threshold. In some cases, the environmental condition data is gathered by a sensor system (e.g., one or more microphones) that may be located at the playback device 30, the demonstration device 20 or a connected device. In some cases, the environmental condition can include an ambient noise level proximate the user, for example, a sound pressure level (SPL) as detected by one or more microphones. When the detected SPL exceeds an SPL threshold, the audio demonstration engine 210 can be configured to recommend that the user adjust his/her location or an aspect of the environment to improve the clarity of the demonstration (e.g., "Consider moving to a quieter location", or "The demo may be less effective in this noisy environment.").

According to various implementations, the audio demonstration engine 210 uses feedback from one or more external microphones on the playback device 30 or the demonstration device 20 to adjust the playback (e.g., volume or noise cancellation settings) of demonstration audio from the demonstration device 20 based on the detected level of ambient noise in the environment. In some cases, this aids in providing a consistent demonstration experience to the user, e.g., where variations in the speaker volume and/or speaker loudness settings at the (wearable) playback device 30 as well as speaker orientation at the playback device 30 affect the demonstration. The audio demonstration engine 210 can use the feedback from the microphones on the playback device 30 or the demonstration device 20 (and/or sensors on another connected device such as a smart device) to adjust the playback volume of the demonstration audio at the playback device 30.

In particular example implementations, where the playback device 30 includes an ANR circuit 184 (FIG. 3) the audio demonstration engine 210 is configured to actively adjust ANR settings or prompt the user 10 to adjust the ANR settings based upon the clarity level for the feature to be demonstrated. In certain cases, the audio demonstration engine 210 is configured to recommend that the user 10 adjust an ANR feature on the playback device 30 when data about the environmental condition (e.g., detected SPL) deviates from an environmental condition threshold for the demonstrated feature. This recommendation can take any form described herein, for example, a visual prompt, audio prompt, etc., and can include a phrase or question prompting the user 10 to adjust the ANR settings (e.g., "Consider engaging CANCEL mode for this demonstration"). In other cases, the audio demonstration engine 210 is configured to automatically adjust the ANR feature (e.g., engage the CANCEL mode or adjust an ANR level) when the detected environmental condition data (e.g., detected SPL) indicates that the clarity level for the demonstrated feature deviates from the environmental condition threshold.

In certain cases, the audio demonstration engine 210 is configured to automatically engage the ANR feature on the playback device 30 when initiating the demonstration at the demonstration device 20, for example, to draw the user's attention to the demonstration. In this case, in response to the receiving user prompt to initiate the demonstration, the audio demonstration engine 210 can detect the device capabilities of the playback device 30 as including ANR (e.g., detecting an ANR circuit 184), and can send instructions to the playback device 30 to initiate the ANR circuit 184 during (and in some cases, prior to and/or after) playback of the demonstration audio file 250. In additional cases, the audio demonstration engine 210 is configured to instruct the user 10 to engage the ANR feature in response to the user command to initiate the demonstration, e.g., to focus the user's attention on the demonstration.

In cases where the audio demonstration engine 210 is demonstrating CNC functions of a wearable audio device 40, the audio demonstration engine 210 can apply filters to the binaural audio that emulate the auditory effect of CNC. In certain cases, the audio demonstration engine 210 is configured to apply filters to the binaural audio that emulate the auditory effect of a set of distinct CNC filters, in a sequence, to the demonstration audio file 250 to demonstrate CNC capabilities of the wearable audio device 40. For example, the audio demonstration engine 210 can apply filters to the binaural audio to demonstrate progressive or regressive sequences of noise cancelling, e.g., to emulate the adjustments that the user can make to noise cancelling functions on the wearable audio device 40 being demonstrated. In some particular cases, the audio demonstration engine 210 (in controlling playback at the playback device 30) applies a first set of filters for a period, then adjusts to a second set of filters for a period, then adjusts to a third set of filters for another period (where periods are identical or distinct from one another). This can be done automatically or via a user input. The user (e.g., user 10, FIG. 1) can then experience the auditory effect of distinct CNC filters and how they compare with one another, just as the user (e.g., user 60, FIG. 1) in the demonstration video would experience that effect.

In additional implementations, the audio demonstration engine 210 can be configured to provide A/B comparisons of processing performed with and without demonstrated functions. Such A/B comparisons can be used in CNC mode, ANR mode, etc. In various implementations, the audio demonstration engine 210 is configured to play back recorded feeds of processed audio and unprocessed audio for the user (via playback device 30) to demonstrate acoustic features of a wearable audio device such as wearable audio device 40. In response to a user command to play back a recorded feed of processed audio (e.g., via an interface command), the audio demonstration engine 210 initiates playback of that processed audio at the playback device 30. Similarly, the audio demonstration engine 210 can initiate playback of unprocessed audio at the playback device 30 in response to a user command (e.g., via an interface command, such as via controls 90 on the video interface 50 shown in FIG. 1). As noted herein, in some examples, the interface (e.g., video interface 50) can be arranged to provide an actuatable icon for each of the processed vs. unprocessed audio, such that the user can toggle between the two feeds to experience the distinction.

The audio demonstration engine 210 is described in some examples as including logic for performing one or more functions. In various implementations, the logic in audio demonstration engine 210 can be continually updated based upon data received from the user (e.g., user selections or commands), sensor data (received from one or more sensors such as microphones, accelerometer/gyroscope/magnetometer(s), etc.) settings updates, as well as updates and/or additions to the library 240 (FIG. 4). While the audio demonstration engine 210 is described as running on or stored on the demonstration device 20, in other examples, the audio demonstration engine 210 could run on or otherwise be stored on the playback device 30. That is, one or more functions of audio demonstration engine 210 can be controlled or otherwise run (e.g., processed) by software and/or hardware that resides at a physically distinct device, such as playback device 30.

As described herein, user prompts can include an audio prompt provided at the demonstration device 20, and/or a visual prompt or tactile/haptic prompt provided at the demonstration device 20 or a distinct device (e.g., an additional connected device or playback device 30). In some particular implementations, actuation of the prompt can be detectable by the demonstration device 20 or any other device where the user is initiating a demonstration, and can include a gesture, tactile actuation and/or voice actuation by user. For example, the user can initiate a head nod or shake to indicate a "yes" or "no" in response to a prompt, which is detected using a head tracker in the playback device 30. In additional implementations, the user can tap a specific surface (e.g., a capacitive touch interface) on the demonstration device 20 and/or playback device 30 to actuate the prompt, or initiate a tactile actuation (e.g., via detectable vibration or movement at one or more sensors such as tactile sensors, accelerometers/gyroscopes/magnetometers, etc.). In still other implementations, the user can speak into a microphone at demonstration device 20 and/or playback device 30 to actuate the prompt and initiate the personalization functions described herein.

In some particular implementations, actuation of the prompt is detectable by the demonstration device 20, such as by a touch screen, vibrations sensor, microphone or other sensor on the demonstration device 20. In certain cases, the prompt can be actuated on the demonstration device 20, regardless of the source of the prompt. In other implementations, the prompt is only actuatable on the device from which it is presented.

With continuing reference to the example in FIGS. 1 and 2, the demonstration processes described according to various implementations can significantly improve the user experience when compared with conventional approaches, for example, by providing the user 10 with a contextual understanding of the capabilities of the wearable audio device 40 being demonstrated, even when that user 10 does not have that wearable audio device 40 available for demonstration. In various implementations, the audio demonstration engine 210 is configured to simulate acoustic features of a wearable audio device 40 that are either not present in the device in-hand (playback device 30), or not easily demonstrated with the device in-hand. The demonstration processes described according to various implementations can increase user awareness of device functions, and provide the curious user with an understanding of possible uses for the wearable audio device 40. Additionally, because the wearable audio device 40 is often used in dynamic settings (travel, commuting, etc.), users can appreciate the various functions of the wearable audio device 40 across these settings.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit). Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other embodiments are within the scope of the following claims.

We claim:

1. A computer-implemented method of demonstrating a feature of a wearable audio device, the method comprising:

receiving a command to initiate an audio demonstration mode at a demonstration device;

initiating binaural playback of a demonstration audio file at a wearable playback device being worn by a user and initiating playback of a corresponding demonstration video file at a video interface coupled with the demonstration device, wherein playback of the demonstration video file depicts a video environment that includes a depiction of a dynamic physical environment, wherein playback of the demonstration video file is synchronized with playback of the demonstration audio file such that the playback of the demonstration audio file represents audio corresponding with the dynamic physical environment;

receiving a user command to adjust a demonstration setting to emulate adjustment of a corresponding setting on the wearable audio device; and adjusting the binaural playback at the wearable playback device based upon the user command.

2. The method of claim 1, further comprising:

receiving data about an environmental condition proximate the wearable playback device;

comparing the data about the environmental condition with an environmental condition threshold corresponding with a clarity level for the feature to be demonstrated; and recommending that the user modify the environmental condition in response to the data about the environmental condition deviating from the environmental condition threshold.

3. The method of claim 1, further comprising:

receiving data about an environmental condition proximate the demonstration device;

comparing the data about the environmental condition with an environmental condition threshold corresponding with a clarity level for the feature to be demonstrated; and either recommending that the user adjust an active noise reduction (ANR) feature in response to the data about the environmental condition deviating from the environmental condition threshold, or automatically adjusting the ANR feature in response to the data about the environmental condition deviating from the environmental condition threshold.

4. The method of claim 1, wherein the wearable playback device is the wearable audio device, or is distinct from the wearable audio device.

5. The method of claim 1, wherein the feature of the wearable audio device comprises at least one of: an active noise reduction (ANR) feature, a controllable noise cancellation (CNC) feature, a compressive hear through feature, a level-dependent noise cancellation feature, a fully aware feature, a music on/off feature, a spatialized audio feature, a directionally focused listening feature, or an environmental distraction masking feature.

6. The method of claim 1, further comprising:

initiating binaural playback of an additional demonstration audio file at the wearable playback device, wherein adjusting the binaural playback comprises mixing the demonstration audio file and the additional demonstration audio file based upon the user command.

7. The method of claim 1, wherein the demonstration audio file comprises a binaural recording of a sound environment, wherein playback of the demonstration video file is synchronized with playback of the demonstration audio file such that the playback of the demonstration audio file represents audio as perceived by a user in the dynamic physical environment, and wherein adjusting the binaural playback at the wearable playback device comprises applying at least one filter to alter the spectrum of the recording.

8. The method of claim 1, wherein the user command to adjust the demonstration setting is received at a user interface on the demonstration device.

9. The method of claim 1, wherein the demonstration device comprises a web browser or a solid state media player, and wherein the binaural playback and demonstration settings for the audio demonstration mode are controlled using the web browser or are remotely controlled using the solid state media player.

10. The method of claim 1, wherein playback of the demonstration video file is synchronized with playback of the demonstration audio file such that the playback of the demonstration audio file represents audio as perceived by a user in the dynamic physical environment.

11. The method of claim 10, wherein the dynamic physical environment depicts the user, and wherein the playback of the demonstration audio file emulates an audio experience of the depicted user in the video environment.

12. A demonstration device comprising:

a command interface for receiving a user command;

a video interface for providing a video output; and a control circuit coupled with the command interface and the video interface, the control circuit configured to demonstrate a feature of a wearable audio device by performing actions comprising:

receiving a command, at the command interface, to initiate an audio demonstration mode;

initiating binaural playback of a demonstration audio file at a transducer on a connected wearable playback device, and initiating playback of a corresponding demonstration video file at the video interface, wherein playback of the demonstration video file depicts a video environment that includes a depiction of a dynamic physical environment, wherein playback of the demonstration video file is synchronized with playback of the demonstration audio file such that the playback of the demonstration audio file represents audio corresponding with the dynamic physical environment;

receiving a user command, at the command interface, to adjust a demonstration setting to emulate adjustment of a corresponding setting on the wearable audio device; and adjusting the binaural playback at the transducer on the wearable playback device based upon the user command.

13. The demonstration device of claim 12, further comprising:

a sensor system coupled with the control circuit, wherein the control circuit is further configured to:

receive data about an environmental condition proximate the demonstration device from the sensor system;

compare the data about the environmental condition with an environmental condition threshold corresponding with a clarity level for the feature to be demonstrated; and recommend that the user modify the environmental condition in response to the data about the environmental condition deviating from the environmental condition threshold.

14. The demonstration device of claim 12, further comprising:

a sensor system coupled with the control circuit, wherein the control circuit is further configured to:

receive data about an environmental condition proximate the demonstration device from the sensor system;

compare the data about the environmental condition with an environmental condition threshold corresponding with a clarity level for the feature to be demonstrated; and either recommend that the user adjust an active noise reduction (ANR) feature in response to the data about the environmental condition deviating from the environmental condition threshold, or automatically adjust the ANR feature in response to the data about the environmental condition deviating from the environmental condition threshold.

15. The demonstration device of claim 12, wherein the feature of the wearable audio device comprises at least one of: an active noise reduction (ANR) feature, a controllable noise cancellation (CNC) feature, a compressive hear through feature, a level-dependent cancellation feature, a fully aware feature, a music on/off feature, a spatialized audio feature, a directionally focused listening feature, or an environmental distraction masking feature.

16. The demonstration device of claim 12, wherein the control circuit is further configured to:

initiate binaural playback of an additional demonstration audio file at the transducer on the wearable playback device, wherein adjusting the binaural playback comprises mixing the demonstration audio file and the additional demonstration audio file based upon the user command.

17. The demonstration device of claim 12, wherein the demonstration audio file comprises a binaural recording of a sound environment, wherein playback of the demonstration video file is synchronized with playback of the demonstration audio file such that the playback of the demonstration audio file represents audio as perceived by a user in the dynamic physical environment, and wherein adjusting the binaural playback at the transducer comprises applying at least one filter to alter the spectrum of the recording.

18. The demonstration device of claim 12, wherein the control circuit comprises a web browser, and wherein the binaural playback and demonstration settings for the audio demonstration mode are controlled using the web browser.

19. The demonstration device of claim 12, wherein the control circuit comprises a solid state media player, and wherein the binaural playback and demonstration settings for the audio demonstration mode are remotely controlled using the solid state media player.

20. The demonstration device of claim 12, wherein playback of the demonstration video file is synchronized with playback of the demonstration audio file such that the playback of the demonstration audio file represents audio as perceived by a user in the dynamic physical environment, wherein the dynamic physical environment depicts the user, and wherein the playback of the demonstration audio file emulates an audio experience of the depicted user in the video environment.

* * * * *